US006199295B1

(12) United States Patent
Smal et al.

(10) Patent No.: US 6,199,295 B1
(45) Date of Patent: Mar. 13, 2001

(54) VARIABLE-CONFIGURATION HAIR DRYER AND NOZZLE

(75) Inventors: Henri C. F. J. Smal, Vise; Pierre L. M. Julemont, Argenteau, both of (BE); Harold R. Taylor, Stratford, CT (US)

(73) Assignee: Conair Corporation, Stamford, CT (US)

( * ) Notice: Subject to any disclaimer, the term of this patent is extended or adjusted under 35 U.S.C. 154(b) by 0 days.

(21) Appl. No.: 09/454,747

(22) Filed: Dec. 6, 1999

(51) Int. Cl.[7] ..... A45D 24/10
(52) U.S. Cl. ..... 34/98
(58) Field of Search ..... 34/95, 96, 97, 34/98, 99, 100; 454/160, 305, 320; 237/12.3 A, 12.3 B; 132/144, 150; 392/380, 382, 384; D28/11, 12, 13

(56) References Cited

U.S. PATENT DOCUMENTS

| | | | | |
|---|---|---|---|---|
| 2,317,798 | * | 4/1943 | Otto | 454/320 X |
| 2,439,444 | * | 4/1948 | Babcock et al. | 454/320 |
| 4,097,722 | | 6/1978 | Soler et al. . | |
| 4,218,608 | | 8/1980 | Maroney . | |
| 4,232,454 | | 11/1980 | Springer . | |
| 4,316,077 | | 2/1982 | Carlson . | |
| 4,430,808 | | 2/1984 | Toyomi et al. . | |
| 4,525,623 | | 6/1985 | Da Silva . | |
| 4,634,839 | | 1/1987 | Gilbertson . | |
| 4,827,105 | | 5/1989 | Brown, Jr. . | |
| 5,054,211 | | 10/1991 | Shulman . | |
| 5,101,883 | * | 4/1992 | Kinmartin et al. | 237/12.3 A X |
| 5,157,757 | | 10/1992 | McDougall . | |
| 5,235,759 | | 8/1993 | Rizzuto, Jr. . | |
| 5,467,540 | | 11/1995 | Bastien . | |
| 5,520,579 | * | 5/1996 | Saida | 454/320 X |
| 5,598,640 | | 2/1997 | Schepisi . | |
| 5,661,910 | | 9/1997 | Schepisi . | |
| 5,784,800 | | 7/1998 | Santhouse et al. . | |
| 5,839,204 | | 11/1998 | Cinque et al. . | |
| 5,842,286 | | 12/1998 | Cantor . | |

FOREIGN PATENT DOCUMENTS

| | | |
|---|---|---|
| 2640857A1 | 12/1988 | (FR) . |

* cited by examiner

*Primary Examiner*—Stephen Gravini
(74) *Attorney, Agent, or Firm*—Ohlandt, Greeley, Ruggiero & Perle

(57) ABSTRACT

A detachable or integral nozzle for a hair dryer is shown that can easily be modified from a first configuration delivering a stream of hot air with an approximately circular cross section, until a stream of air is produced with an approximately rectangular cross section, that is broad and flat. The nozzle includes a sleeve fitted with two folding vents capable of making an axial pivoting movement about geometrical axes, and a pair of flaps capable of making a pivoting movement about geometrical axes perpendicular to the pivot axes of the folding vents.

13 Claims, 7 Drawing Sheets

VARIABLE-CONFIGURATION HAIR DRYER AND NOZZLE

FIELD OF THE INVENTION

The present invention relates to a hair dryer and a hair dryer nozzle whose shape can be modified to deliver either an essentially cylindrical stream of air (that is, with a circular cross section), or a stream of air in the form of a relatively broad flat lamina.

BACKGROUND OF THE INVENTION

Electric hair dryers are designed to produce a stream of air which is heated by an electrical element and is delivered by action of a fan. The very design of the hair dryer, in particular its cylindrical circular-section geometry which must house the fan, gives the stream of air a circular cross section. In certain cases, however, users want a relatively broad flat lamina of air.

To accomplish a laminar flow, it is usual practice to fit a nozzle on the outlet end of the hair dryer where the stream of air is produced. The nozzle ends in a flattened outlet generally in the form of an elongate rectangle. A nozzle of this kind can be fitted permanently to the outlet opening of the hair dryer, but it is usually detachable. In the case of a detachable nozzle, the user may mislay it, and thus, experiences the nuisance of looking after an extra component.

While the hair dryer is in use, the circular stream and the broad flat stream are sometimes found to be alternately necessary and thus oblige the user to remove and replace the nozzle. This quickly becomes a nuisance, especially as it is hot.

The prior art includes a number of teachings regarding various air flow configurations from hair dryers. French Patent 2 640 857 to Bomtoux illustrates a nozzle arrangement which is configured from a flexible material. Rotation of the nozzle causes a mechanism to alter the nozzle's cylindrical opening to a rectangular configuration so as to create a laminar air flow.

U.S. Pat. No. 5,467,540 to Bastien describes an air diffuser that is mountable on the exhaust end of a hair dryer. Within the barrel of the diffuser is a perforated valve plate which can be rotated to partially block air flow. Under such circumstances, heated air exits through the valve plate perforations and through perforations that are present about the circumference of the barrel.

U.S. Pat. Nos. 5,598,640 and 5,661,910 to Schepisi describe a hair dryer having a diffuser mounted on its exhaust end. A pair of flapper valve plates in the diffuser can be actuated to either block the principle air opening or to open it. The barrel includes a plurality of holes which act as exhaust holes when the principal air exhaust path is closed by the flapper valves. Air exhaust through the barrel is controlled by the positioning of a cylinder that is slidably mounted thereon. By moving the cylinder, the flapper valves are actuated and holes in the cylinder line-up with holes in the barrel of the hair dryer.

U.S. Pat. No. 5,157,757 to McDougall describes a hand-held hair dryer which includes a rotatable valve that blocks, in one position, air flow through a central exhaust path and redirects the air flow through openings in the barrel.

U.S. Pat. No. 5,054,211 to Shulman describes a hair dryer attachment that includes an air deflection plate that is rotatable about an axis that is coextensive with the axis of the air exhaust path of the hair dryer. U.S. Pat. No. 4,525,623; to DaSilva describes a hair dryer with an air outlet that includes a pair of valve members that are pivotally mounted. The positioning of the valve members is controlled by a knob that extends through the dryer housing.

U.S. Pat. No. 5,842,286 to Cantor describes a hair dryer having a barrel with a plurality of holes positioned about its periphery. Separate chambers are provided within the barrel to direct hot air, both to a principal exit and to the holes that are positioned along the barrel.

SUMMARY OF THE INVENTION

The object of the present invention is to provide both a detachable nozzle for a hair dryer and a hair dryer with a fixed nozzle, both of which can easily be modified from a first configuration delivering a stream of hot air of circular cross section, to a stream of air with an approximately rectangular cross section, that is to say broad and flat.

The term "rectangular" must be understood as including shapes having slightly circular or even oval-like corners or sides. Similarly the term "circular" can be applied to slightly oval shapes.

The invention avoids the drawbacks of the prior art where, when the hair dryer is in use, the standard circular stream and the broad flat stream are found to be alternately necessary, thus obliging the user to remove and replace the nozzle.

More specifically, an object of the invention is to produce a mechanism that can be fitted to or is integral with a hair dryer, in order to make it easy to provide a nozzle of variable shapes, capable of delivering both a circular-sectioned stream of air as well as a broad flat stream of air.

BRIEF DESCRIPTION OF THE DRAWINGS

The invention will be described in greater detail with reference to certain preferred embodiments illustrated hereinafter in the ended drawings.

DESCRIPTION OF THE PREFERRED EMBODIMENT

Figure 1:
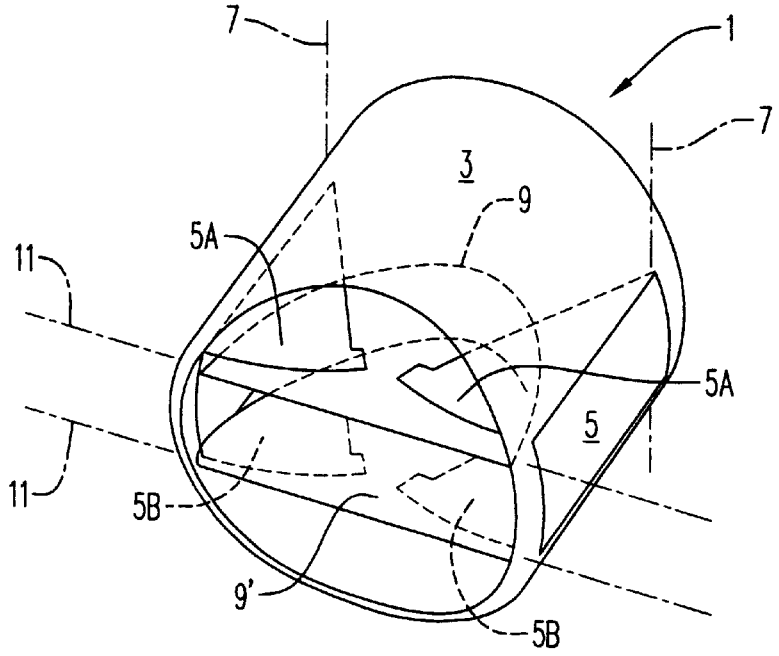
FIG. 1 shows a perspective view of a nozzle in a first position producing a stream of hot air of circular cross section.

With reference to FIG. 1, nozzle 1 may be an integral part of a hair dryer or a separate item which can be fitted to an existing hair dryer. Nozzle 1 comprises a cylindrical or frustoconical sleeve 3, one end of which is either an integral part of a hair dryer, as illustrated in FIGS. 5–9, or can be fitted to the outlet orifice of a hair dryer.

In one position (FIGS. 1 and 3), the stream of air released at the outlet of the nozzle is of a substantially circular cross section. For certain applications, however, the user may want a stream of air in the form of a relatively broad flat lamina. To produce this effect, sleeve 3 is fitted with two folding vents 5 that are capable of making a pivoting movement about geometric axes 7, and with two flaps 9 capable of making a pivoting movement about geometric axes 11. Axes 11 are orthogonal to pivot axes 7 of vents 5.

Figure 3:
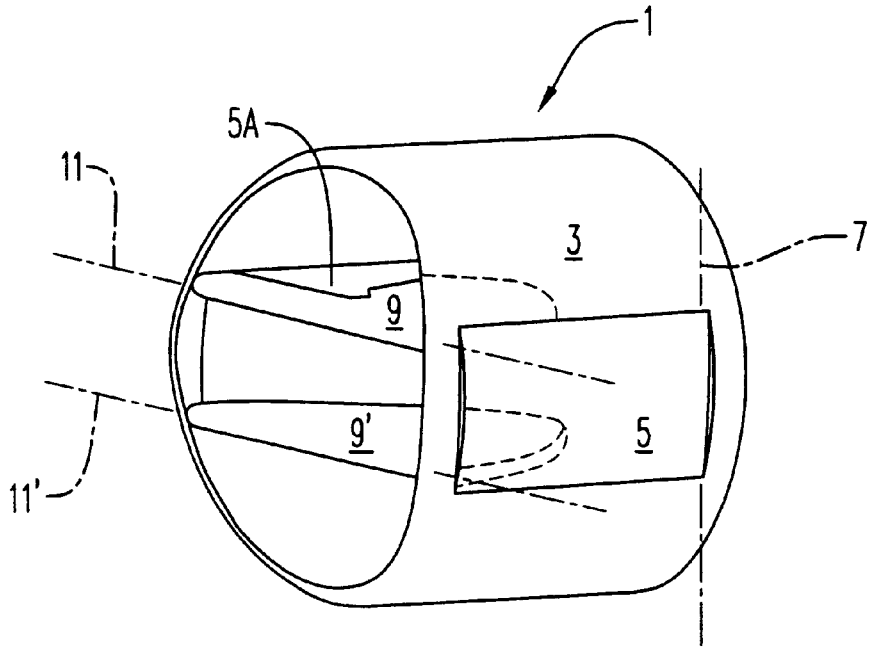
FIGS. 3 and 4 show other perspective view similar to FIGS. 1 and 2, respectively, which show more clearly the movement of the flaps with which the hair-dryer nozzle is fitted.

In the position shown in FIGS. 1 and 3, flaps 9 are parallel to the axis of the stream of air corresponding to the shape of sleeve 3, and vents 5 are in a closed position. As shown, upper walls 5A of vents 5 slide over the upper flap 9 and the lower walls 5B of these same vents 5 slide under lower flap 9'.

In this configuration, a stream of hot air continues to maintain a circular cross section that is divided into three longitudinal slices (in sleeve 3) by flaps 9 and 9' that are positioned parallel to the air flow stream flow.

The configuration of the sides of vents 5 may, of course, be adapted to be slightly circular so as to match the general circular shape of the sleeve 3 when in the closed position.

Figure 2:
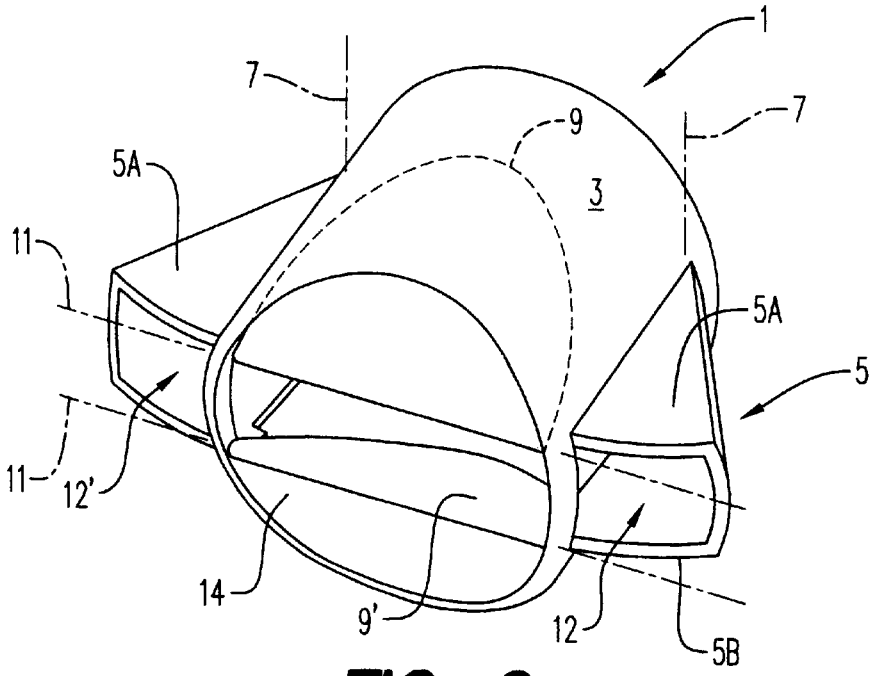
FIG. 2 is a view corresponding to FIG. 1 in which the nozzle releases a stream of hot air in the form of a broad flat lamina.
Figure 4:
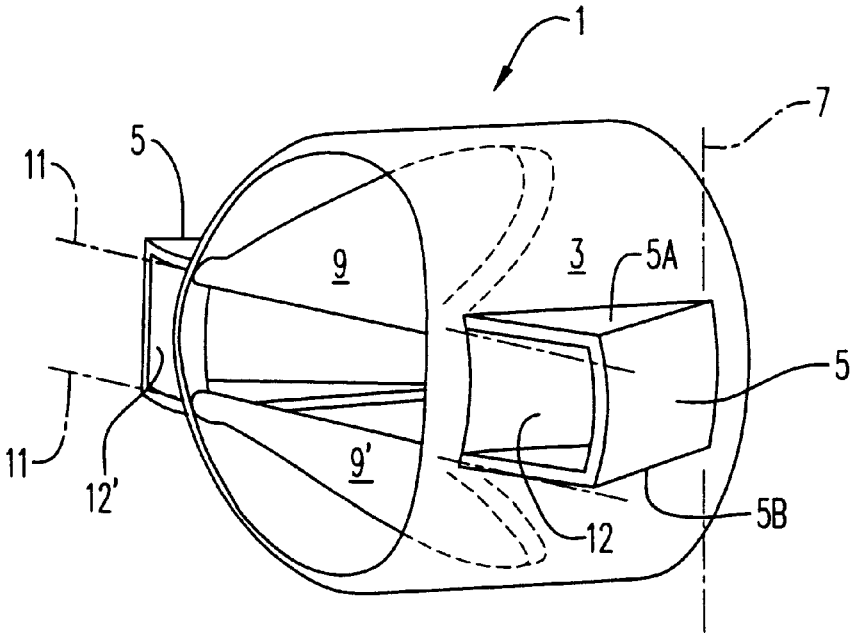

To bring about the pivoting movements of the folding vents 5 and flaps 9 and 9' about their respective axes 7 and 11, suitable control means are provided as described below with respect to FIG. 9. In order to modify the configuration of the nozzle, vents 5 are pivoted about the geometrical axes 7 so as to provide air flow paths 12 and 12'. Simultaneously, as vents 5 are opened, walls 5A and 5B are removed from flaps 9 and 9' (see FIGS. 2 and 4).

Flaps 9 and 9' are spring biased to rotate away from each other about axes 11. Accordingly, flaps 9 and 9' are enabled to rotate until they respectively engage the inner walls of sleeve 3. The initially circular-sectioned stream of air therefore strikes flaps 9 and 9' and is directed towards and out rectangular opening 14.

Simultaneously the stream of air also diverges to the left and right, following the sides of the now open vents 5, giving a stream of air which is of a generally rectangular laminar shape.

Any appropriate means can be used to bring about modification of the air flow configuration. Springs (not shown) may, for example, be used to act on flaps 9, 9' and folding vents 5 to keep them in the positions shown in FIGS. 2 and 4. A force may be applied, for example with the aid of a ring (not shown) whose diameter is slightly greater than that of the sleeve 3 and which is slid so as to cover the folding vents 5 progressively from the rear to the front. Under such a condition, walls 5A and 5B bear on the outer surfaces of flap 9, 9', respectively and act against the force of the bias springs. This action, in addition to closing vents 5, pushes flaps 9, 9' towards positions that are aligned with the axis of sleeve 3, as shown in FIGS. 1 and 3.

A slight fillet may be provided, either on the folding vents (the extremities of the upper wall or lower wall) or on the flaps, if necessary. In practice, it has been found that movements of the vents and flaps occurs easily, without excessive friction and without significant loss of cross-sectional opening for the passage of the stream of air, when switching from the position in FIG. 1 to that in FIG. 3. The folding side vents can, if of appropriate dimension, maintain a reasonable cross section for the air stream (when flattened), which corresponds to about two thirds of the circular cross section.

Figure 5:
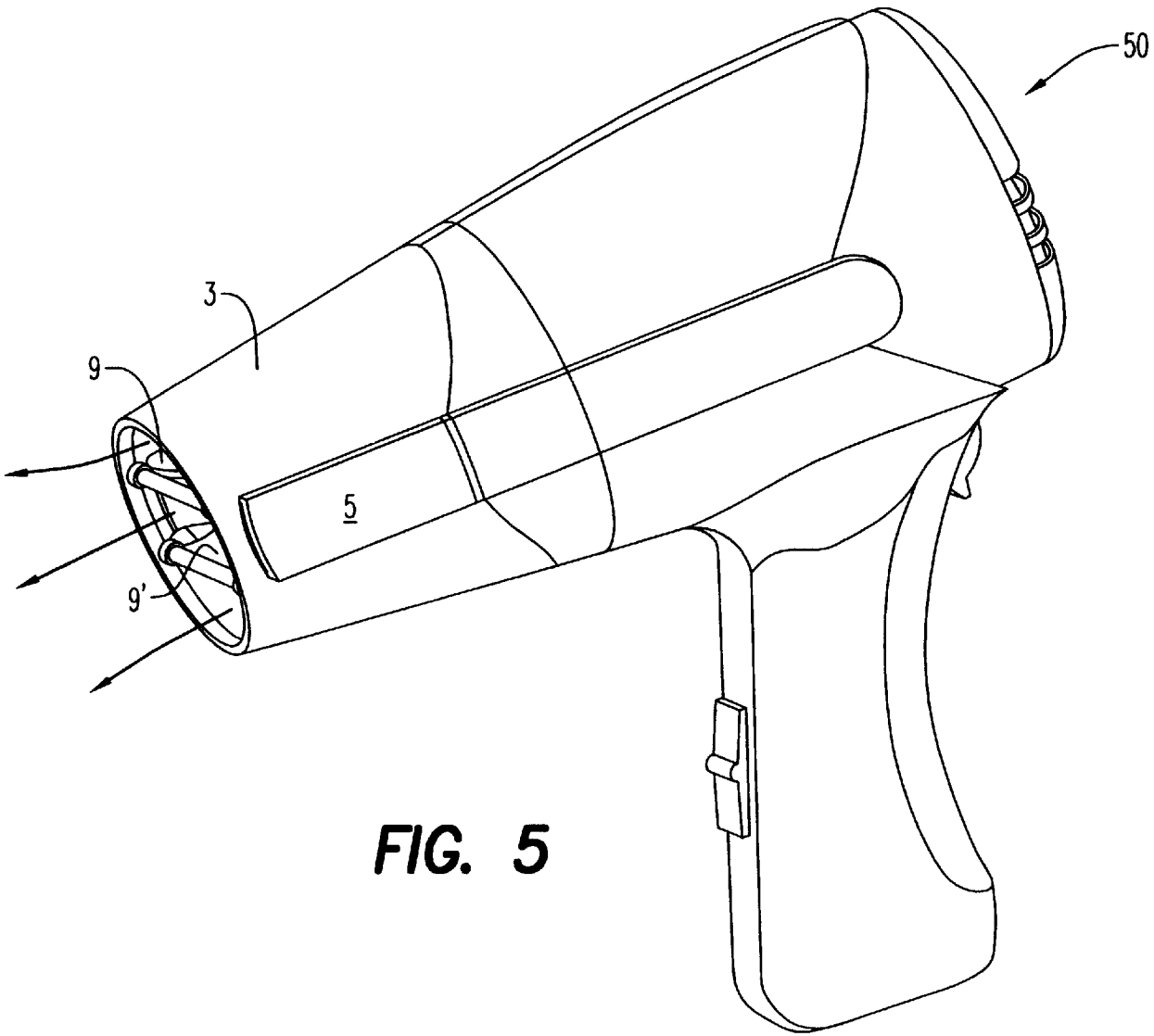
FIG. 5 is a perspective view of a hair dryer of the invention with pop-out vents in a close position.
Figure 6:
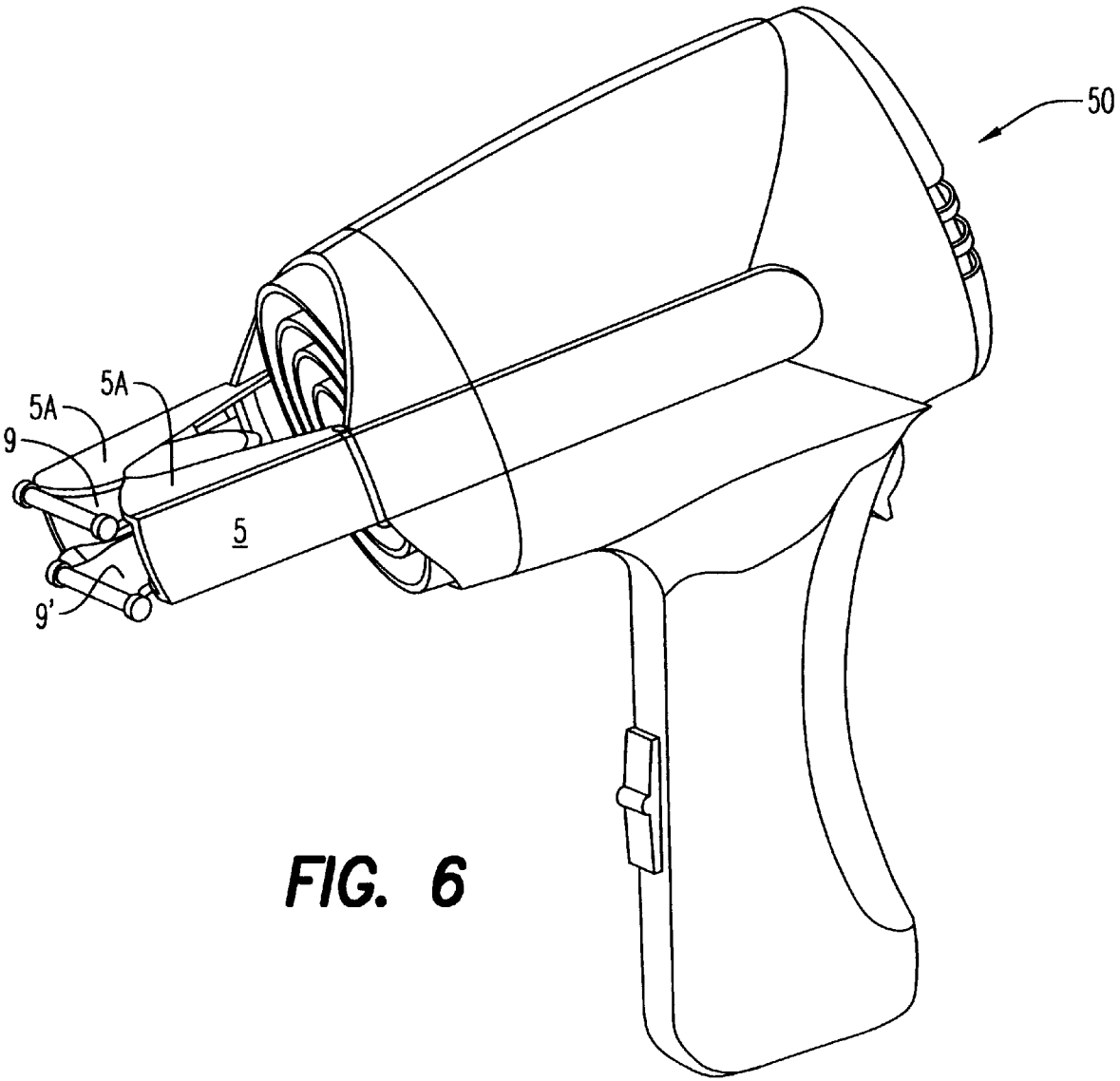
FIG. 6 is the perspective view of FIG. 5, with a cover portion removed.

FIGS. 5–9 illustrate a hair blower 50 with an integral nozzle of a design substantially identical to that shown in FIGS. 1–4. FIG. 5 illustrates hair blower 50, with vents 5 in their respective closed positions and with walls 5A and 5B maintaining flaps 9 and 9' in alignment with the direction of air flow. FIG. 6 is the same as FIG. 5, but with sleeve 3 removed to enable the positions of vents 5 and flaps 9 and 9' to be better visualized.

Figure 7:
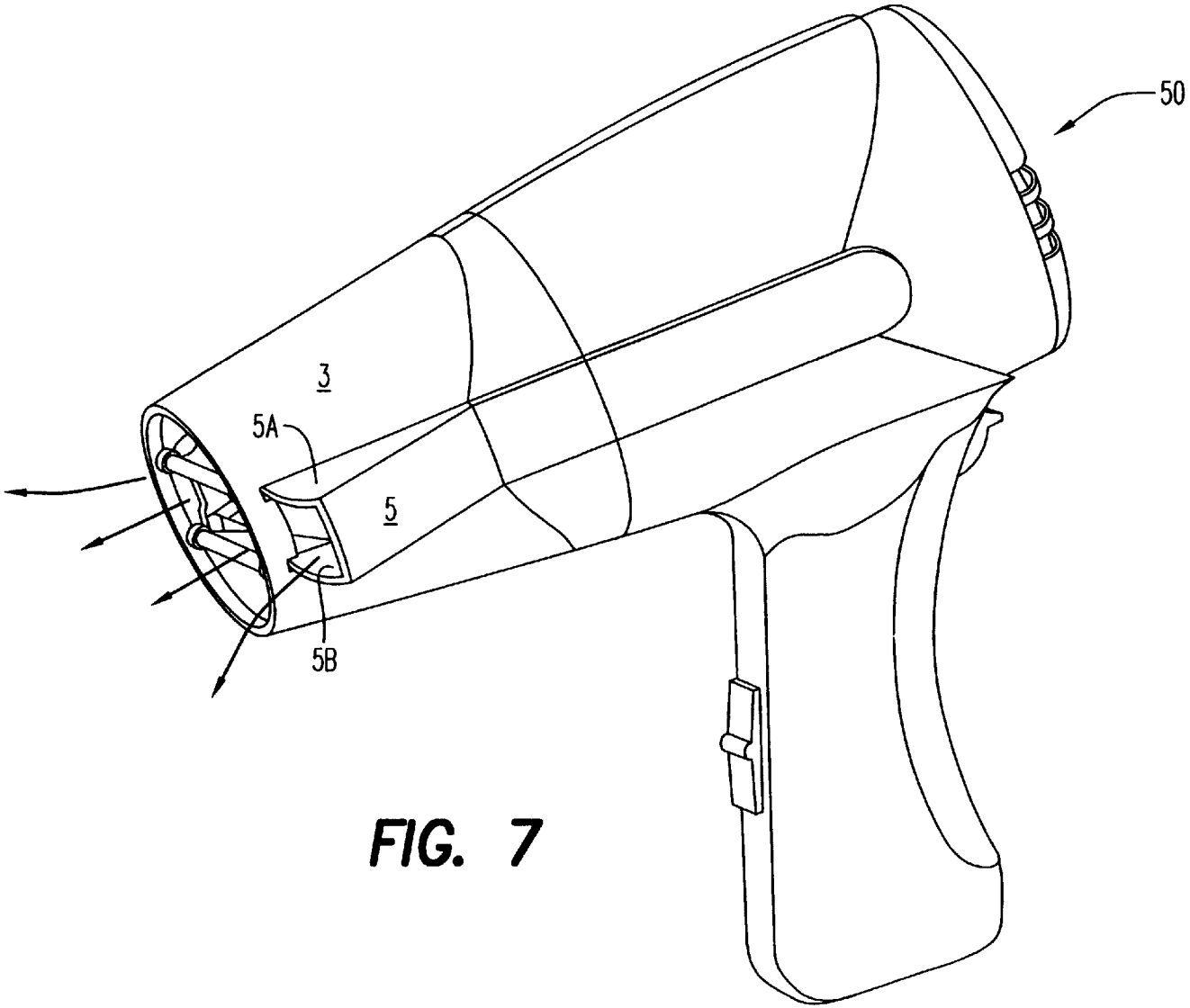
FIG. 7 is a perspective view of the hair dryer of FIG. 5, with pop-out vents in an open position.
Figure 8:
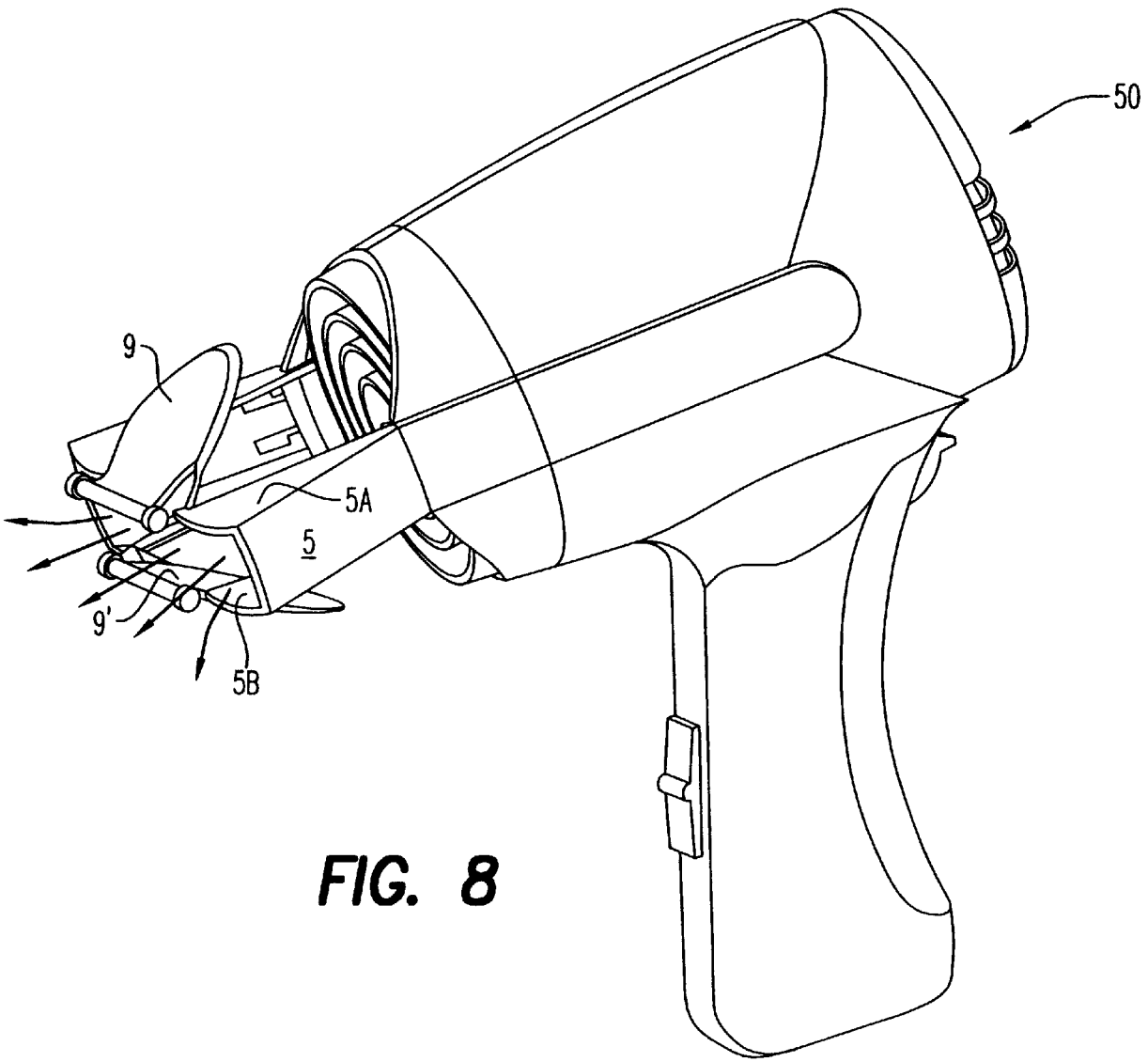
FIG. 8 is the perspective view of FIG. 7, with a cover portion removed.

FIGS. 7 and 8 illustrate hair blower 50 with vents 5 in the open position. The opening of vents 5 causes walls 5A and 5B to be withdrawn from over/under flaps 9 and 9'. Spring bias members act on flaps 9 and 9' and cause them to rotate away from each other until they abut the inner walls of sleeve 3 and close off air flow, except through opening 14 and vents 5.

Figure 9:
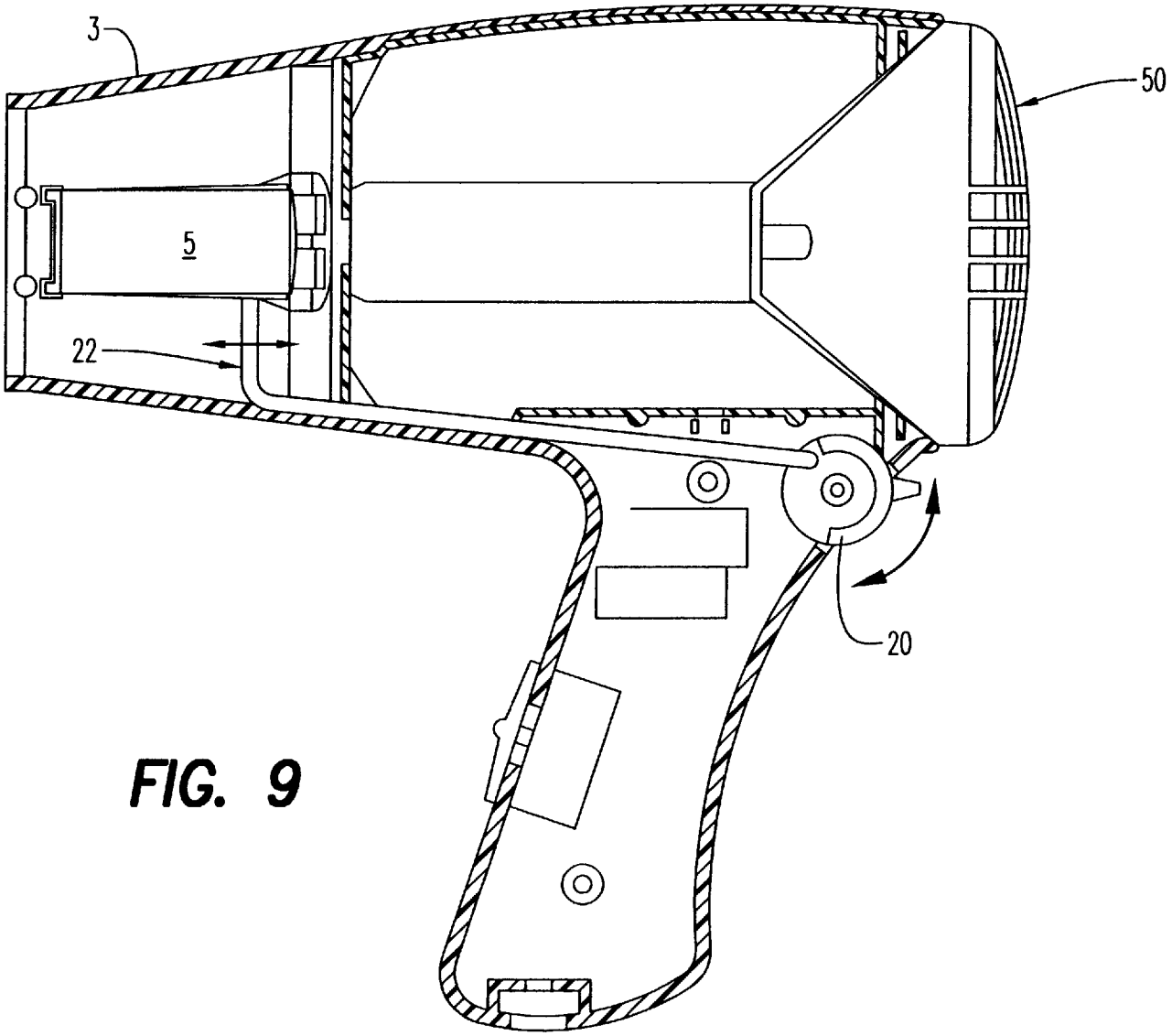
FIG. 9 is the side sectional view of the hair dryer of FIGS. 5–8.

FIG. 9 illustrates a mechanism used to control the positions of vents 5. A control wheel 20 is coupled to an L-shaped actuating rod 22 which, in turn, is coupled to walls 5B. Actuation of wheel 20 in a counter-clockwise direction by the user, moves rod 22 to the left and causes vents 5 to rotate outwardly to the open position. At the same time, as flaps 9 and 9' are no longer blocked by the wall portions of vents 5, they rotate away from each other. Actuation of wheel 20 in a clockwise direction by the user, moves rod 22 to the right and causes vents 5 to rotate inwardly to the closed position. The wall portions of vents 5 ride up over flaps 9 and 9' and force them towards each other.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A hair dryer device for directing an air flow in at least one of two forms, the device comprising:

a) a sleeve portion;

b) a first deflector and a second deflector, both pivotally mounted on axes that extend across said sleeve portion, said axes displaced from each other so as to provide a first air channel therebetween, and second and third air channels on opposed sides thereof;

c) a first vent and a second vent, each pivotally positioned on opposed sides of said sleeve portion; and d) means for moving said first vent and second vent from closed positions to open positions, and said first deflector and said second deflector to positions that respectively close said second and third air channels and direct air flow through said first air channel and said first vent and said second vent.

2. The hair dryer device of claim 1, wherein the sleeve portion is approximately circular and provides a circular outflow of air when said deflectors are positioned parallel to the axis of the sleeve portion and said first vent and said second vent are in closed positions.

3. The hair dryer device of claim 1, wherein the sleeve portion is approximately circular and provides a laminar outflow of air when said deflectors are positioned to close said second and third air channels and said first vent and second vent are in open positions.

4. The hair dryer device of claim 1, wherein each said first vent and a second vent includes wall portions that bear upon respective deflectors, each said deflector spring biased to pivot about an axis, said wall portions causing said deflectors to be moved against said spring bias to an orientation parallel to a direction of air flow, when said vents are in the closed position.

5. The hair dryer device of claim 1, wherein each said first vent and a second vent includes wall portions that bear upon respective deflectors, each deflector spring biased to pivot about an axis, said wall portions, when said vents are in the open position, being substantially removed from said deflectors so as to enable spring bias actions to move said deflectors to block said second and third air channels.

6. The hair dryer device of claim 1, wherein said sleeve is configured to be fitted to an outlet orifice of a hair dryer in a detachable manner.

7. A hair dryer including a motor-driven fan for providing a stream of air, said hair dryer comprising:

a) a conduit portion for directing said stream of air;

b) a first deflector and a second deflector, both pivotally mounted on axes that extend across said conduit portion, said axes displaced from each other so as to provide a first air channel therebetween, and second and third air channels on opposed sides thereof;

c) a first vent and a second vent, each pivotally positioned on opposed sides of said conduit portion; and d) user operable means for moving said first vent and second vent from closed positions to open positions, and said first deflector and said second deflector to positions that respectively close said second and third air channels and direct said stream of air through said first air channel and said first vent and said second vent.

8. The hair dryer of claim 7, wherein the conduit portion is approximately circular and provides a circular outflow of air when said deflectors are positioned parallel to the axis of the conduit portion and said first vent and second vent are in closed positions.

9. The hair dryer of claim 7, wherein the conduit portion is approximately circular and provides a laminar outflow of air when said deflectors are positioned to close said second and third air channels and said first vent and second vent are in open positions.

10. The hair dryer of claim 7, wherein each said first vent and a second vent includes wall portions that bear upon respective deflectors, each deflector spring biased to pivot about respective axes, said wall portions causing said deflectors to be moved against said spring bias to an orientation parallel to a direction of said stream of air, when said vents are in the closed position.

11. The hair dryer of claim 7, wherein each said first vent and a second vent includes wall portions that bear upon respective deflectors, each deflector spring biased to pivot about respective axes, said wall portions, when said vents are in the open position, being substantially removed from said deflectors so as to enable spring bias actions to move said deflectors to block said second and third air channels.

12. The hair dryer of claim 7, further comprising:

a user-operable control device; and means for coupling said control device to said first vent and second vent, whereby operation of said control device enables an opening or closing of said vents.

13. The hair dryer of claim 12, wherein said user-operable control device is mounted on a handle portion of said hair dryer and is coupled to said vents by a direct coupling.

* * * * *